US006655362B2

(12) United States Patent
Rembold et al.

(10) Patent No.: US 6,655,362 B2
(45) Date of Patent: Dec. 2, 2003

(54) HIGH-PRESSURE FUEL PUMP WITH VARIABLE DELIVERY QUANTITY

(75) Inventors: Helmut Rembold, Stuttgart (DE); Bruno Schmidt, Stuttgart (DE); Dietmar Krieg, Unterensingen (DE); Mathias Schumacher, Asperg (DE); Uwe Mueller, Hemmingen (DE)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 09/983,500

(22) Filed: Oct. 24, 2001

(65) Prior Publication Data

US 2002/0053338 A1 May 9, 2002

(30) Foreign Application Priority Data

Oct. 24, 2000 (DE) ..... 100 52 629

(51) Int. Cl.[7] ..... F02M 37/04
(52) U.S. Cl. ..... 123/506; 123/459
(58) Field of Search ..... 123/506, 508, 123/514, 459, 458

(56) References Cited

U.S. PATENT DOCUMENTS

| | | | | | |
|---|---|---|---|---|---|
| 5,197,438 | A | * | 3/1993 | Kumano et al. | 123/506 |
| 5,230,613 | A | * | 7/1993 | Hilsbos et al. | 417/439 |
| 5,404,855 | A | * | 4/1995 | Yen et al. | 123/446 |
| 5,529,042 | A | * | 6/1996 | Augustin et al. | 123/456 |
| 5,577,892 | A | * | 11/1996 | Schittler et al. | 417/53 |
| 5,911,208 | A | * | 6/1999 | Furusawa et al. | 123/506 |
| 6,095,118 | A | * | 8/2000 | Klinger et al. | 123/446 |
| 6,135,090 | A | * | 10/2000 | Kawachi et al. | 123/446 |
| 6,209,522 | B1 | * | 4/2001 | Onishi et al. | 123/458 |

* cited by examiner

*Primary Examiner*—Mahmoud Gimie
(74) *Attorney, Agent, or Firm*—Ronald E. Greigg

(57) ABSTRACT

A high-pressure fuel pump which is suitable above all for use in internal combustion engines with direct gasoline injection, in which the pressure surge upon opening of a check valve between the high-pressure line and the pumping chamber of the fuel feed pump is limited by structural provisions.

14 Claims, 3 Drawing Sheets

HIGH-PRESSURE FUEL PUMP WITH VARIABLE DELIVERY QUANTITY

BACKGROUND OF THE INVENTION

1. Field of the Invention

The invention relates to a high-pressure fuel pump with a variable delivery quantity for an internal combustion engine, having a camshaft-actuated piston that aspirates fuel from a low-pressure line into a pumping chamber and then pumps it into a high-pressure line, and having a quantity control valve connecting the pumping chamber and the low-pressure line.

2. Description of the Prior Art

In a high-pressure fuel pump of the type with which this invention is concerned, which is known from European Patent Disclosure EP 481 964 B2, the delivery quantity is regulated by providing that the quantity control valve is closed at the onset of the pumping stroke and is opened during the pumping stroke. Because of the idle volume in the pumping chamber, at the instant of opening of the outlet valve (onset of pumping in the high-pressure line and rail), the piston already has a high speed. Because of the liquid column available at this instant in the high-pressure line, which column has to be accelerated, this leads to a pressure surge. This pressure surge makes exact quantity metering in the injection of fuel into the combustion chamber more difficult and moreover causes a pulsating load on the high-pressure line and the common rail. In addition, the mechanical stresses on the high-pressure fuel pump and the camshaft, because of the surgelike load at the onset of fuel pumping into the high-pressure line, are very high.

OBJECT AND SUMMARY OF THE INVENTION

It is the object of the invention to furnish a high-pressure fuel pump with a variable delivery quantity, in which the pressure surges in the high-pressure line and in the common rail are markedly reduced, compared to the prior art, and the mechanical stresses on the high-pressure fuel pump are reduced.

According to the invention, this object is attained by a high-pressure fuel pump with a variable delivery quantity for an internal combustion engine, having a piston actuated by a camshaft, wherein the piston aspirates fuel from a low-pressure line into a pumping chamber and then pumps it into a high-pressure line; between the pumping chamber and the low-pressure line, a quantity control valve and a separate suction valve are connected parallel, and the regulation of the delivery quantity is effected by opening the quantity control valve during the pumping stroke of the piston.

In the high-pressure fuel pump of the invention, a pressure increase takes place in the pumping chamber at the onset of the pumping stroke. As soon as the pressure force in the pumping chamber is greater than the sum of the pressure force in the high-pressure line, which force is decoupled from the pumping chamber by an outlet valve, and the spring force of the outlet valve, the high-pressure fuel pump begins to pump fuel into the high-pressure line. As soon as enough fuel has been pumped into the high-pressure line, the quantity control valve opens, so that the pressure in the pumping chamber collapses, and the outlet valve between the high-pressure line and the pumping chamber closes. Since in the above-described quantity regulation the pressure increase in the pumping chamber always takes place from bottom dead center (BDC) of the piston onward, the pressure course in the pumping chamber and hence also in the high-pressure line can be designed, independently of the rpm and the operating point of the internal combustion engine, in such a way that the pressure surges in the high-pressure line and in the common rail and the surgelike loads on the high-pressure fuel pump are reduced. The magnitude of the pressure surge depends on the speed of the cam at the instant of opening of the outlet valve.

In a variant of the invention, it is provided that each cam of the camshaft has at least a first rotational angle range, a second rotational angle range and a third rotational angle range, the bottom dead center (BDC) of the piston being located within the first rotational angle range; that after reaching BDC, in the first rotational angle range, the piston is imparted a positive acceleration by the cam; that within the second rotational angle range the stroke speed VH/omega of the piston is approximately constant; that the outlet valve of the high-pressure pump opens while the cam is passing through the second rotational angle range; and that within the third rotational angle range, the stroke speed of the piston increases until a maximum value is reached.

The second rotational angle range, with an approximately constant stroke speed $V_H$/omega that is as low as possible, has the advantage that regardless of the delivery quantity, that is, the instant at which the outlet valve opens, depends essentially only on the rpm of the camshaft. It is thus possible, by the choice of a low stroke speed, to limit the pressure surge $P_S$ to an allowable amount, even at maximum high-pressure fuel pump rpm and maximum pressure in the high-pressure line. As a result, the injection quantity can be controlled with greater accuracy, and the aforementioned pulsating loads and surgelike loads are reduced.

In a further feature of the invention, the acceleration of the piston in the first rotational angle range, at the allowable maximum rpm of the high-pressure fuel pump, is limited essentially by the forces of inertia of the piston, so that the first rotational angle range can be kept as small as possible. This allows making the second rotational angle range correspondingly larger. Since at the onset of the pumping stroke, the piston causes only a pressure increase of the fuel in the pumping chamber and need not perform pressure increasing work counter to the pressure in the high-pressure line, the acceleration of the piston in the first rotational angle range can assume a very high value.

In a further feature of the invention, in the second rotational angle range, at the allowable maximum rpm of the high-pressure fuel pump, the piston experiences no positive acceleration or a positive acceleration that is less than the acceleration in the first rotational angle range. Compared to a constant stroke speed $V_H$/omega, it is possible by means of a slight positive acceleration—on the condition that the allowable pressure surges $P_S$ in the high-pressure line are not exceeded—to increase the stroke speed of the piston in the second rotational angle range as well and thus to attain the same pumping stroke within a smaller rotational angle range. By this provision, the maximum stroke speed of the piston can be reduced, which at high rpm of the high-pressure fuel pump leads to a reduction in flow losses at the quantity control valve upon diversion and thus enhances pump efficiency.

In a further feature of the high-pressure fuel pump of the invention, the acceleration of the piston in the third rotational angle range at the allowable maximum rpm of the high-pressure fuel pump is limited by the maximum allowable pressure, so that on the one hand the maximum piston speed in the pumping stroke is reached as quickly as possible, and on the other, no allowable stresses on the high-pressure fuel pump occur. In the third rotational angle range, the piston does have to perform work counter to the pressure in the high-pressure line.

In another feature of the invention, it is also provided that each cam has a fourth, a fifth, and a sixth rotational angle range; that the top dead center (TDC) of the piston is located between the fourth rotational angle range and the fifth rotational angle range; that the positive acceleration of the piston by the cam becomes negative in the fourth rotational angle range; that in the fifth rotational angle range, the piston is imparted a negative acceleration by the cam; and that within the sixth rotational angle range, the stroke speed of the piston is negative and approximately constant. As a result, the intake stroke is made possible with reduced mechanical stress on the fuel pump and less cavitation. This advantage is still greater if in the fourth and fifth rotational angle range, the change in speed of the piston is approximately constant.

In one embodiment of the high-pressure fuel pump, the quantity control valve is a magnet valve that is open when without current, so that impermissible pressures in the fuel feed pump are prevented even if the quantity control valve or its triggering fails.

In a further feature of the invention, at the transition from the sixth rotational angle range to the first rotational angle range, the intake speed decreases slowly, so that the overflow losses from excessively late closure of the inlet valve are reduced.

BRIEF DESCRIPTION OF THE DRAWING

The invention will be better understood and further objects and advantages thereof will become more apparent from the ensuing detailed description of a preferred embodiment taken in conjunction with the drawings, in which.

DESCRIPTION OF THE PREFERRED EMBODIMENTS

Figure 1:
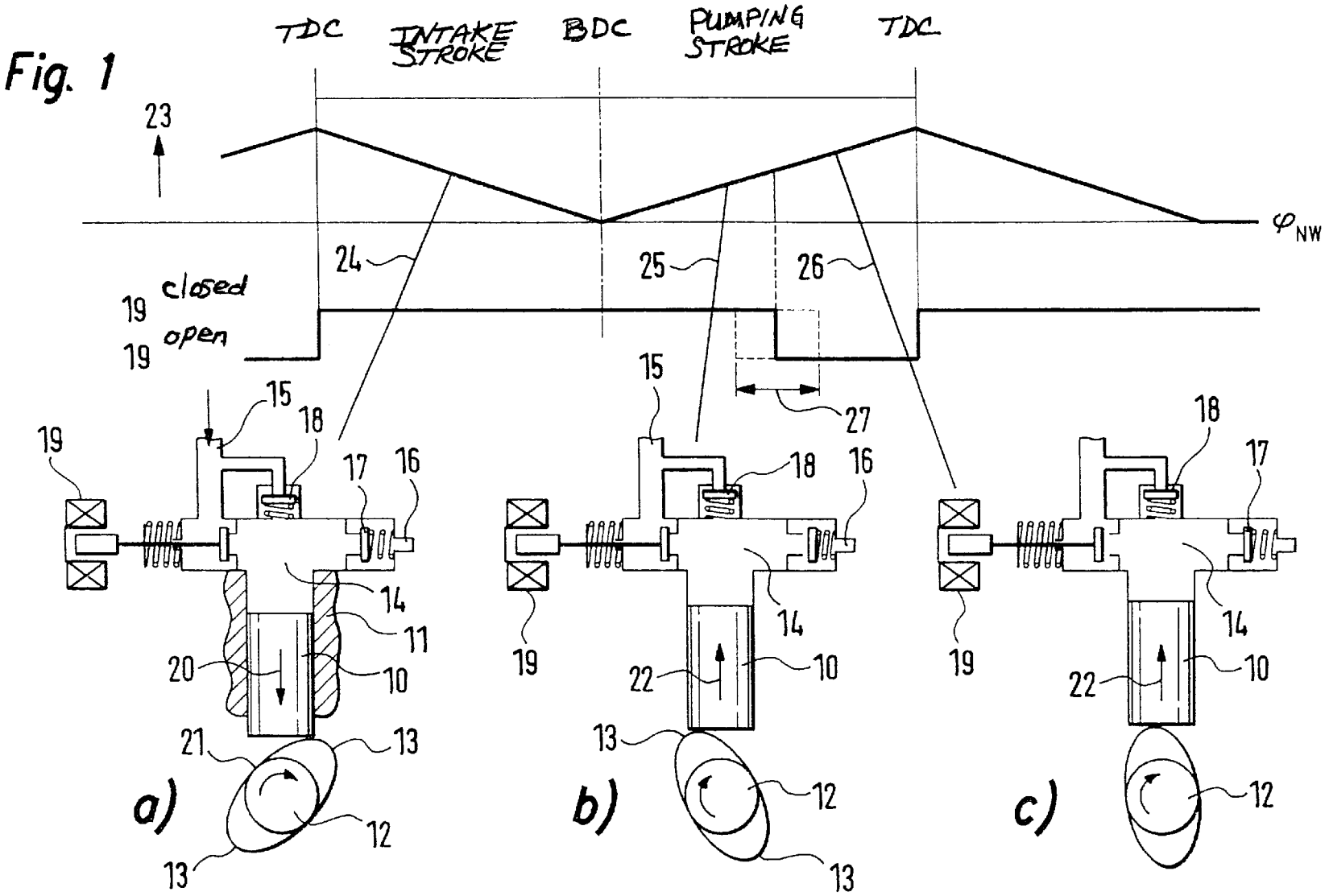
FIGS. 1*a*–1*c* are schematic view of a high-pressure fuel pump in three different operating states, with a graph plotting the stroke and the rotational angle.

In FIG. 1, an injection pump comprising a piston 10, which is guided in a cylinder 11 and is driven by a camshaft 12 with two cams 13, is shown schematically. The piston 10 defines a pumping chamber 14, into which a low-pressure line 15 and a high-pressure line 16 discharge. Between the high-pressure line 16 and the pumping chamber 14, an outlet valve 17 is provided, which prevents a return flow of the fuel, located in the high-pressure line 16, to the pumping chamber 14. The high-pressure line 16 can discharge into a common rail, not shown, or can communicate directly with injectors or injection nozzles.

The fuel present in the low-pressure line 15 can be aspirated via a suction valve 18 into the pumping chamber 14 when the piston 10 moves downward, as shown in FIG. 1*a*, and thus increases the size of the pumping chamber 14. Alternatively, via a quantity control valve 19, a hydraulic communication can be established between the pumping chamber 14 and the low-pressure line 15. In FIG. 1*a*, the quantity control valve 19, embodied as a magnet valve, is closed. When the piston 10 moves from a top dead center (TDC), not shown in FIG. 1*a*, in the direction of the arrow 20 toward bottom dead center (BDC), also not shown in FIG. 1*a*, fuel flows from the low-pressure line 15 via the suction valve 18 into the pumping chamber 14. The quantity control valve 19 is closed during the intake stroke. As soon as the camshaft 12 has rotated far enough that point 21 touches the piston 10, BDC has been reached. The pumping stroke then begins.

As the piston 10 passes through BDC, the same pressure prevails in both the pumping chamber 14 and the low-pressure line 15, so that the spring-loaded suction valve 18 closes. As soon as the piston 10 moves upward in the direction of the arrow 22 (FIG. 1*b*), the pressure in the pumping chamber 14 increases. Once the pressure force in the pumping chamber 14 is greater than the sum of the pressure force prevailing in the high-pressure line 16 and the spring force of the outlet valve 17, the outlet valve 17 opens, and the pumping of fuel into the high-pressure line 16 begins. This state is shown in FIG. 1*b*. The suction valve 18 and the quantity control valve 19 are closed.

Once enough fuel has been pumped out of the pumping chamber 14 into the high-pressure line 16, the quantity control valve 19 is opened. As a result, the pressure in the pumping chamber 14 collapses, and the outlet valve 17 closes. The pumping of fuel out of the pumping chamber 14 into the high-pressure line 16 is thus ended. Until TDC is reached, the piston 10 pumps fuel out of the pumping chamber 14 into the low-pressure line 15. Because the pressure in the low-pressure line 15 is only slight, the pumping work of the piston 10 in this switching state (FIG. 1*c*) is very slight.

In the top half of FIG. 1, the stroke 23 of the piston 10 is plotted schematically over the rotational angle $\phi_{NW}$ of the camshaft 12. The states shown in FIGS. 1*a*, 1*b* and 1*c* are associated by means of lines 24, 25 and 26 with the corresponding portions in the above graph. In the graph in FIG. 1, the switching position of the quantity control valve 19 is also shown. This clearly shows that by the opening of the closed quantity control valve 19, the pumping of fuel into the high-pressure line 16 is terminated.

As a function of the load state of the engine that is equipped with the high-pressure fuel pump of the invention, the opening of the quantity control valve 19 can be varied as shown within a range 27 between BDC and TDC.

The camshaft 12 has two cams 13, so that two intake and pumping strokes can be performed by the piston 10 per camshaft revolution.

Figure 2:
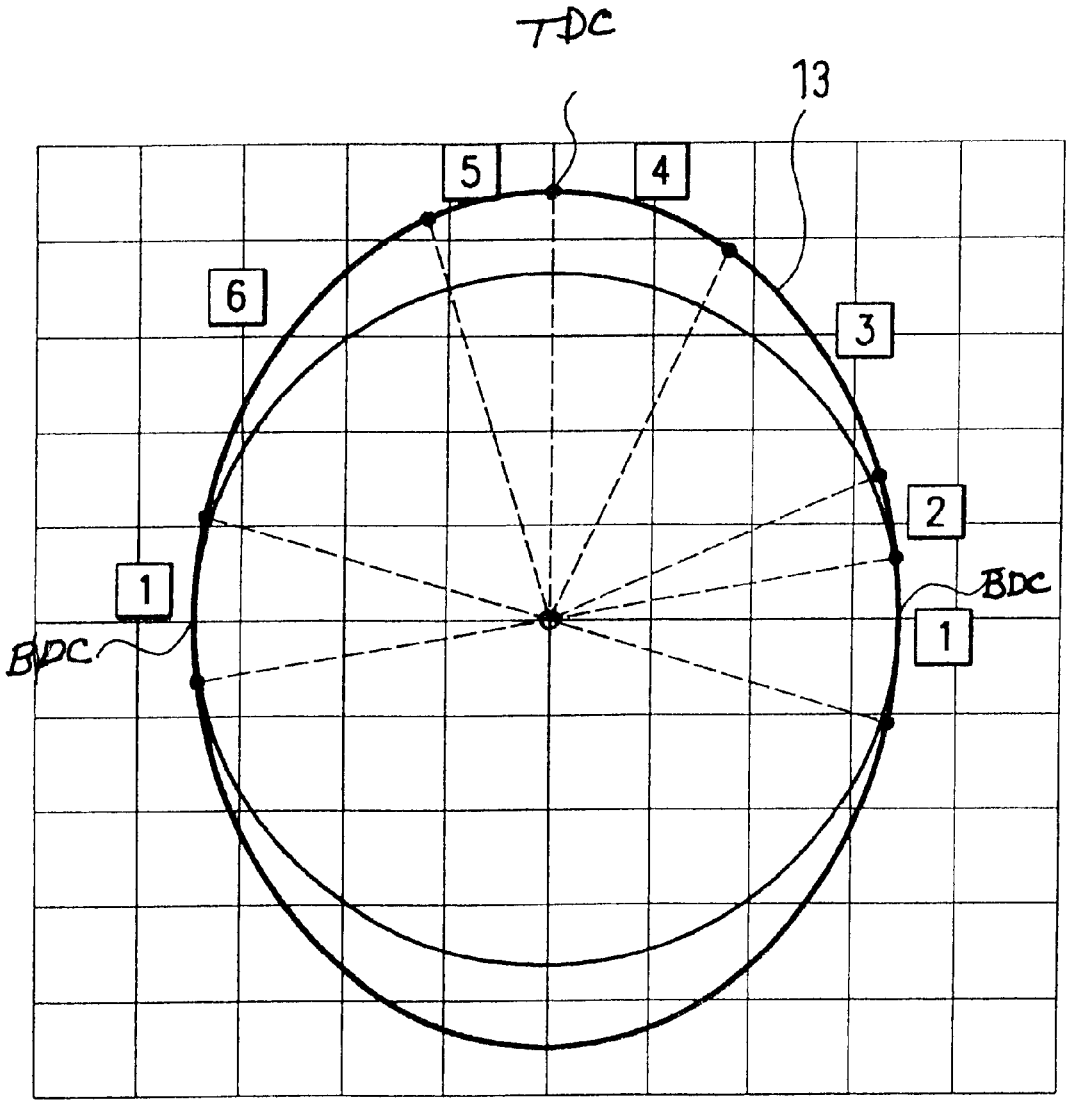
FIG. 2 shows the contour of a cam according to the invention.
Figure 3:
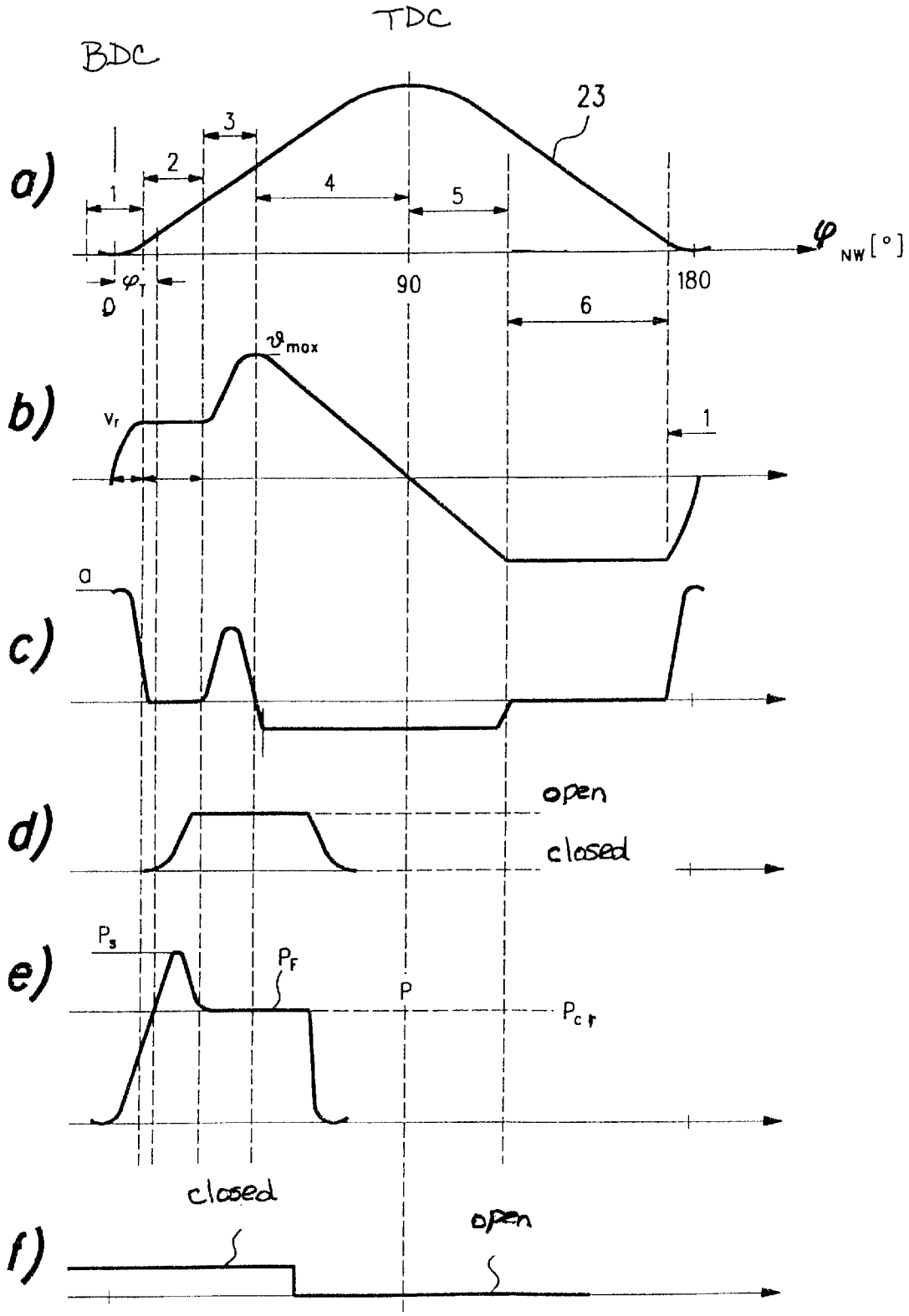
FIGS. 3*a*–3*f* show the course of the cam stroke, the cam speed and acceleration, the outlet valve stroke, the pumping chamber pressure, and the status of the quantity control valve, plotted over the rotational angle of the camshaft.

In FIG. 2, the camshaft 12 is shown in somewhat greater detail. The contour of the cam 13 has been subdivided into six rotational angle ranges 1–6, which will be described below in detail in conjunction with FIG. 3.

FIG. 3*a* shows the stroke 23 of the cam 13 in the radial direction, and thus also shows the stroke of the piston 10, plotted over the rotational angle (PNW of the camshaft 12. In FIG. 3*b*, the speed $v_r$ of the cam 13 in the radial direction is plotted. The speed $v_r$ corresponds to the speed of the piston 10. In FIG. 3*c*, the acceleration a of the piston 10 is shown plotted over the rotational angle $\phi_{NW}$ of the camshaft 12. In FIG. 3*d*, the position of the outlet valve 17 is shown. FIG. 3*e* shows the course of the pressure $P_F$ in the pumping chamber 14 plotted over the rotational angle $\phi_{NW}$, while in FIG. 3*f*, the switching position of the quantity control valve 19 is shown.

Beginning at BDC, the pressure $P_F$ in the pumping chamber rises sharply. After the opening of the outlet valve 17, the liquid column in the line between the high-pressure fuel pump and the rail is accelerated abruptly, in accordance with the cam speed at the instant of the overflow. As the rotary speeds rise, the result is an overelevation of pressure in the pumping chamber 14. This overelevation of pressure reaches a maximum, marked Ps in FIG. 3*e*, and then, once the outlet valve 17 is opened, proceeds in the form of a pressure surge through the high-pressure line 16. When this pressure surge reaches the common rail, an injection nozzle, or an injector, it can lead to imprecise fuel meterings in injection. Moreover, the overelevation of pressure leads to a severe load on the cam drive of the pump. The overelevation of pressure in the pumping chamber 14 should therefore be as slight as possible, compared to the rail pressure $P_{cr}$ prevailing in the high-pressure line 16. That is, the difference between $P_S$ and $P_{cr}$ should be as slight as possible. This goal can be attained, with the design of the cam 13 as described below.

As a function of the pressure $P_{cr}$ in the high-pressure line 16, the outlet valve 17 opens earlier or later. Because of the volumetric losses between the piston 10 and the cylinder 11 and because of the compressibility of the fuel located in the pumping chamber and the elasticity of the wall, not shown in FIG. 1, of the injection pump surrounding the pumping chamber 14, a certain pumping stroke is necessary in order to build up a pressure in the pumping chamber 14. With knowledge of the properties of a specific high-pressure fuel pump, a rotational angle range can thus be indicated within which the outlet valve 17 will not open in any case. This rotational angle range is marked 1 in FIG. 3*a*.

The rotational angle range 1 is smaller, the lower the pressure $P_{cr}$ in the high-pressure line and the smaller the volume in the pumping chamber 14 and the greater the elasticity of the wall surrounding the pumping chamber 14.

Regardless of the rpm, at otherwise identical peripheral conditions, the outlet valve 17 opens at the latest when the pressure $P_{cr}$ prevailing in the high-pressure line 16 is equivalent to the maximum allowable operating pressure of the common rail. That is, for each high-pressure fuel pump, a second rotational angle range 2 can be indicated, dependent on the aforementioned parameters, within which range the outlet valve 17 opens.

To prevent the aforementioned pressure surges, above all at high rpm and high pressure $P_{cr}$, from becoming excessively strong, it is provided that the speed of is the piston stroke $v_r$ is constant in the second rotational angle range 2. This plateau can be seen clearly in FIG. 3*b*. As soon as the second rotational angle range 2 has been traversed, the speed of the piston stroke increases until it reaches a maximum $V_{max}$.

The acceleration a in the third rotational angle range 3 is selected such that once the maximum allowable speed is reached, and after the transition to a fourth range, the maximum negative acceleration is such that at the contact point between the cam 13 and the piston 10, at the highest allowable pressure $P_{cr}$, the allowable Hertzian pressure is not exceeded. The pressure forces that act on the piston and the forces of inertia must be taken into account here.

Once the maximum speed $v_{max}$ is reached, a fourth rotational angle range 4 begins, which is characterized by the fact that the acceleration a becomes negative. The value of the acceleration is limited by the maximum allowable Hertzian pressure. During virtually the entire fourth rotational angle range 4 and an ensuing fifth rotational angle range 5, the acceleration a is constantly negative, which means that the speed of the piston 10 is decreasing. Once TDC is reached, the speed becomes negative; that is, the intake stroke begins. At the end of the fifth rotational angle range 5, the piston 10 has a certain negative speed, which it maintains constantly over a sixth rotational angle range 6. In the fifth rotational angle range and the sixth rotational angle range, the aspiration of fuel takes place out of the low-pressure line 15 into the pumping chamber 14. The sixth rotational angle range 6 is followed again by a first rotational angle range 1. The rotational angle range 1 is characterized in that the acceleration a of the piston 10 is selected to be as high as possible. The possible acceleration is essentially limited by the forces of inertia of the piston 10, since in the region of BDC, hydraulic forces acting from the pumping chamber on the piston 10 are comparatively slight. For this reason, the maximum acceleration in the first rotational angle range is markedly greater than the maximum acceleration in the third rotational angle range 3.

Because the acceleration a of the piston 10 is maximized in the first rotational angle range 1, the second rotational angle range 2 can be correspondingly larger. In an alternative feature, instead of a constant speed of the piston 10 in the second rotational angle range 2, a slight acceleration of the piston 10 can also take place. The precondition for this, however, is that in all operating states, the pressure peak $P_S$ upon opening of the outlet valve 17 does not become excessively high. In the third rotational angle range 3, it is recommended that the acceleration a of the piston 10 be selected to be as high as possible, so that the requisite delivery quantity can be reached with the lowest possible maximum speed $v_{max}$ of the piston 10. The lower the maximum speed $v_{max}$ of the piston 10, the less are the flow losses upon diversion by the quantity control valve 19. This improves the efficiency of the high-pressure fuel pump.

The remarks above pertaining to the shape of the contour of the cam 13 from the first rotational angle range 1 to the sixth rotational angle range 6 can fundamentally be applied to all high-pressure fuel pumps according to the invention. The specific design of the contour of the cam 13, however, can be done only with knowledge of the requisite operating pressures $P_{cr}$ in the common rail, rotary speeds of the high-pressure fuel pump, compressibility of the fuel, elasticity of the walls surrounding the pumping chamber 14, and other variables. However, one skilled in the art in the field of high-pressure fuel pumps can accomplish this using simulation calculations or other aids. The high-pressure fuel pump of the invention is especially well suited for use in internal combustion engines with direct gasoline injection.

The foregoing relates to a preferred exemplary embodiment of the invention, it being understood that other variants and embodiments thereof are possible within the spirit and scope of the invention, the latter being defined by the appended claims.

We claim:

1. A high-pressure fuel pump with a variable delivery quantity for an internal combustion engine, comprising a piston (10) actuated by a camshaft (12) wherein the piston (10) aspirates fuel from a low-pressure line (15) into a pumping chamber (14) and then pumps it into a high-pressure line (16), and a quantity control valve (19) connecting the pumping chamber (14) and the low-pressure line (15), and a separate suction valve (18) disposed between the low-pressure line (15) and the pumping chamber (14), the regulation of the delivery quantity being effected by opening the quantity control valve (19) during the pumping stroke of the piston, wherein said quantity control valve (19) is a magnet valve that is open when without current.

2. A high-pressure fuel pump with a variable delivery quantity for an internal combustion engine, comprising a piston (10) actuated by a camshaft (12) wherein the piston (10) aspirates fuel from a low-pressure line (15) into a pumping chamber (14) and then pumps it into a high-pressure line (16), and a quantity control valve (19) connecting the pumping chamber (14) and the low-pressure line (15), and a separate suction valve (18) disposed between the low-pressure line (15) and the pumping chamber (14), the regulation of the delivery quantity being effected by opening the quantity control valve (19) during the pumping stroke of the piston, wherein the quantity control valve (19) is regulated by a control unit as a function of the rpm, load, and temperature of the internal combustion engine, the voltage of the on-board electrical system, and the temperature of the aspirated air and the pressure in the common rail.

3. A high-pressure fuel pump with a variable delivery quantity for an internal combustion engine, comprising a piston (10) actuated by a camshaft (12) wherein the piston (10) aspirates fuel from a low-pressure line (15) into a pumping chamber (14) and then pumps it into a high-pressure line (16), and a quantity control valve (19) connecting the pumping chamber (14) and the low-pressure line (15), and a separate suction valve (18) disposed between the low-pressure line (15) and the pumping chamber (14), the regulation of the delivery quantity being effected by opening the quantity control valve (19) during the pumping stroke of the piston, the camshaft having at least one cam (13), wherein each cam (13) of the camshaft (12) has at least a first rotational angle range (1), a second rotational angle range (2) and a third rotational angle range (3), the bottom dead center (BDC) of the piston (23) being located within the first rotational angle range (1); that after reaching BDC, in the first rotational angle range (1), the piston (10) is imparted a positive acceleration by the cam (13); that within the second rotational angle range (2) the stroke speed ($V_r$) of the piston (10) is approximately constant; that the quantity control valve (19) opens while the cam (13) is passing through the second rotational angle range; and that within the third rotational angle range (3), the stroke speed ($V_r$) of the piston (10) increases until a maximum value ($V_{max}$) is reached.

4. The high-pressure fuel pump according to claim 3, wherein the acceleration of the piston (10) in the first rotational angle range (1), at the allowable maximum rpm of the high-pressure fuel pump, is limited essentially by the forces of inertia of the piston (10).

5. The high-pressure fuel pump according to claim 3, wherein in the second rotational angle range (2), at the allowable maximum rpm of the high-pressure fuel pump, the piston (10) experiences a lesser positive acceleration compared to the acceleration in the first rotational angle range (1).

6. The high-pressure fuel pump according to claim 3, wherein the acceleration of the piston in the fourth rotational angle range (4) at the allowable maximum rpm of the high-pressure fuel pump is limited by the maximum allowable Hertzian pressure at the contact point between the cam (13) and the piston (10).

7. The high-pressure fuel pump according to claim 4, wherein the acceleration of the piston in the fourth rotational angle range (4) at the allowable maximum rpm of the high-pressure fuel pump is limited by the maximum allowable Hertzian pressure at the contact point between the cam (13) and the piston (10).

8. The high-pressure fuel pump according to claim 5, wherein the acceleration of the piston in the fourth rotational angle range (4) at the allowable maximum rpm of the high-pressure fuel pump is limited by the maximum allowable Hertzian pressure at the contact point between the cam (13) and the piston (10).

9. The high-pressure fuel pump according to claim 3, wherein each cam (13) comprises a fourth rotational angle range (4), a fifth rotational angle range (5), and a sixth rotational angle range (6); that the top dead center (TDC) of the piston (10) is located between the fourth rotational angle range (4) and the fifth rotational angle range (5); that the positive acceleration of the piston (10) by the cam (13) is reduced to zero in the fourth rotational angle range (4); that in the fifth rotational angle range (5), the piston (10) is imparted a negative acceleration by the cam (13); and that within the sixth rotational angle range (6), the stroke speed ($V_r$) of the piston (10) is negative and approximately constant.

10. The high-pressure fuel pump according to claim 4, wherein each cam (13) comprises a fourth rotational angle range (4), a fifth rotational angle range (5), and a sixth rotational angle range (6); that the top dead center (TDC) of the piston (10) is located between the fourth rotational angle range (4) and the fifth rotational angle range (5); that the positive acceleration of the piston (10) by the cam (13) is reduced to zero in the fourth rotational angle range (4); that in the fifth rotational angle range (5), the piston (10) is imparted a negative acceleration by the cam (13); and that within the sixth rotational angle range (6), the stroke speed ($V_r$) of the piston (10) is negative and approximately constant.

11. The high-pressure fuel pump according to claim 5, wherein each cam (13) comprises a fourth rotational angle range (4), a fifth rotational angle range (5), and a sixth rotational angle range (6); that the top dead center (TDC) of the piston (10) is located between the fourth rotational angle range (4) and the fifth rotational angle range (5); that the positive acceleration of the piston (10) by the cam (13) is reduced to zero in the fourth rotational angle range (4); that in the fifth rotational angle range (5), the piston (10) is imparted a negative acceleration by the cam (13); and that within the sixth rotational angle range (6), the stroke speed ($V_r$) of the piston (10) is negative and approximately constant.

12. The high-pressure fuel pump according to claim 6, wherein each cam (13) comprises a fourth rotational angle range (4), a fifth rotational angle range (5), and a sixth rotational angle range (6); that the top dead center (TDC) of the piston (10) is located between the fourth rotational angle range (4) and the fifth rotational angle range (5); that the positive acceleration of the piston (10) by the cam (13) is reduced to zero in the fourth rotational angle range (4); that in the fifth rotational angle range (5), the piston (10) is imparted a negative acceleration by the cam (13); and that within the sixth rotational angle range (6), the stroke speed ($V_r$) of the piston (10) is negative and approximately constant.

13. The high-pressure fuel pump according to claim 9, wherein in the fourth and fifth rotational angle range (4, 5), the change in speed of the piston (10) is approximately constant.

14. The high-pressure fuel pump according to claim 3, wherein before the transition from the sixth rotational angle range (6) to the first rotational angle range (1), the intake speed of the piston decreases slowly.

* * * * *